United States Patent [19]

Sato et al.

[11] 4,021,251

[45] May 3, 1977

[54] SILVER HALIDE PHOTOGRAPHIC EMULSIONS

[75] Inventors: Akira Sato; Akira Ogawa; Masanao Hinata; Haruo Takei, all of Minami-ashigara, Japan

[73] Assignee: Fuji Photo Film Co., Ltd., Minami-ashigara, Japan

[22] Filed: Apr. 16, 1975

[21] Appl. No.: 568,757

[30] Foreign Application Priority Data

Apr. 17, 1974 Japan ..... 49-42861

[52] U.S. Cl. ..... 96/140

[51] Int. Cl.[2] ..... G03C 1/22

[58] Field of Search ..... 96/140

[56] References Cited

UNITED STATES PATENTS

| | | | |
|---|---|---|---|
| 3,071,467 | 1/1963 | Rauch | 96/140 |
| 3,698,910 | 10/1972 | Sakazume et al. | 96/140 |
| 3,736,145 | 5/1973 | Hirata et al. | 96/140 |
| 3,765,900 | 10/1973 | Depoorter et al. | 96/140 |

*Primary Examiner*—J. Travis Brown

*Attorney, Agent, or Firm*—Sughrue, Rothwell, Mion, Zinn & Macpeak

[57] ABSTRACT

Silver halide photographic emulsions which contain at least one sensitizing dye represented by the formula (I)

(I)

wherein Z represents a group of atoms necessary to form a benzisoxazole nucleus; $R_1$ represents an aliphatic group; $R_2$ represents an aliphatic group or an aryl group; and $R_3$ represents an aryl group or an alkenyl group.

22 Claims, 4 Drawing Figures

SILVER HALIDE PHOTOGRAPHIC EMULSIONS

BACKGROUND OF THE INVENTION

1. Field of the Invention

The present invention relates to silver halide photographic emulsions spectrally sensitized with novel merocyanine dyes and particularly to silver halide photographic emulsions having high blue sensitivity and high green sensitivity.

2. Description of the Prior Art

It is known that many kinds of cyanine dyes and merocyanine dyes can be used for spectral sensitization of silver halide photographic emulsions.

However, although many types of merocyanine dyes have been studied and developed hitherto, their sensitization is not yet sufficient from a practical standpoint. Although some merocyanine dyes have a quite excellent sensitization, they easily generate fog and the sensitivity of the photosensitive material remarkably decreases during the storage thereof. Further, the merocyanine dyes remaining in the silver halide layers after development stain the resulting images. Thus, it is desired in the photographic field to solve these technical problems.

SUMMARY OF THE INVENTION

Accordingly, a first object of the present invention is to provide silver halide photographic emulsions having a remarkably improved spectral sensitization wherein generation of fog is decreased.

A second object of the invention is to provide spectrally sensitized silver halide photographic emulsions wherein the decrease of the sensitivity with the lapse of time after production is reduced.

A third object of the present invention is to provide silver halide photographic emulsions spectrally sensitized with sensitizing dyes which do not result in residual color (due to the dyes) after development and have excellent solubility.

These objects of the present invention are attained effectively with silver halide photographic emulsions, containing novel merocyanine dyes represented by the following formula (I)

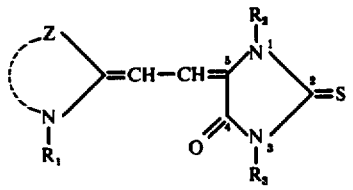

(I)

wherein Z represents a group of atoms necessary to form a benzisoxazole nucleus; $R_1$ represents an aliphatic group; $R_2$ represents an aliphatic group or an aryl group; and $R_3$ represents an aryl group or an alkenyl group.

DETAILED DESCRIPTION OF THE INVENTION

Figure 1:
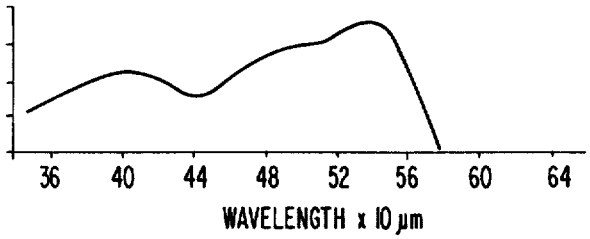
FIG. 1 shows the spectral sensitization curve of a photographic emulsion (immediately after preparation) produced using Sensitizing Dye (1) of the present invention in an amount of $32 \times 10^{-5}$ mols per Kg of the emulsion.

In the general formula (I), Z represents a group of atoms necessary to form a benzisoxazole nucleus and the carbon atoms of this nucleus can be unsubstituted or substituted. Examples of suitable nuclei include an unsubstituted benzisoxazole nucleus and benzisoxazole nuclei substituted with halogen atoms (for example, chlorine or bromine), alkyl groups (e.g., preferably having 1 to 4 carbon atoms and including substituted alkyl groups: for example, methyl or ethyl, etc., and the substituted alkyl groups containing a substituent such as a halogen (e.g., chlorine, bromine, etc.), an alkoxy group (e.g., a methoxy group or ethoxy group etc.), a hydroxy group, or an aryl group (e.g., a phenyl group, etc.)), alkoxy groups (e.g., preferably having 1 to 4 carbon atoms, for example, methoxy or ethoxy etc.), hydroxy groups or aryl groups (unsubstituted aryl groups, (for example, phenyl) or substituted aryl group substituted with one or more halogens (for example, chlorine or bromine), alkyl groups (for example, methyl or ethyl, etc.) or alkoxy groups (for example, methoxy or ethoxy, etc.) as substituents). In greater detail, examples of suitable nuclei include benzisoxazole, 5-chlorobenzisoxazole, 4,6-dichlorobenzisoxazole, 4,6-dibromobenzisoxazole, 7-methylbenzisoxazole, 6-methylbenzisoxazole, 6,7-dimethylbenzisoxazole, 7-ethylbenzisoxazole, 7-methoxybenzisoxazole, 6-methoxybenzisoxazole, 6-hydroxybenzisoxazole, 7-phenylbenzisoxazole and 5-chloro-7-ethylbenzisoxazole, etc.

$R_1$ represents an aliphatic group, for example, an unsubstituted alkyl group (for example, having 1 to 8 carbon atoms such as a methyl group, an ethyl group, a propyl group or a butyl group) or a substituted alkyl group (wherein the preferred alkyl moiety has 1 to 4 carbon atoms (for example, a sulfo group substituted alkyl group such as a sulfoalkyl group (for example, a β-sulfoethyl group, a γ-sulfopropyl group, a γ-sulfobutyl group or a δ-sulfobutyl group), a sulfoalkoxyalkyl group (for example, a sulfoethoxyethyl group or a sulfopropoxyethoxyethyl group, etc.) or a hydroxysulfoalkyl group (for example, a 2-hydroxy-3-sulfopropyl group), etc.), a carboxyalkyl group (for example, a β-carboxyethyl group, an ω-carboxybutyl group or a carboxymethyl group, etc.), a hydroxyalkyl group (for example, a β-hydroxyethyl group or a γ-hydroxypropyl group, etc.), an alkoxyalkyl group, namely, an unsubstituted alkoxyalkyl group (for example, a β-methoxyethyl group or a γ-methoxypropyl group, etc.), a substituted alkoxy alkyl group (for example, a hydroxyalkoxyalkyl group (for example, a hydroxymethoxymethyl group, a 2-hydroxyethoxymethyl group or a 2-(2-hydroxyethoxy)ethyl group, etc.) or an acetoxyalkoxyalkyl group (for example, a 2-(2-acetoxyethoxy)ethyl group or an acetoxymethyl group, etc.), etc.), an acyloxyalkyl group (for example, a β-acetoxyethyl group or a ω-propionyloxybutyl group, etc.), an alkoxycarbonylalkyl group (for example, a methoxycarbonylmethyl group, a β-methoxycarbonylethyl group or an ω-ethoxycarbonylbutyl group, etc.), a sulfonatoalkyl group (for example, a β-sulfonatoethyl group or a ω-sulfonatobutyl group, etc.), an aralkyl group (for example, a benzyl group, a phenethyl group or a p-sulfobenzyl group, etc.), or an alkenyl group (for example, an allyl group, etc.), etc.).

$R_2$ represents an aliphatic group, for example, an unsubstituted alkyl group (for example, having 1 to 4 carbon atoms for example, a methyl group, ethyl group, propyl group or butyl group, etc.), a substituted alkyl group (wherein the preferred alkyl moiety has 1 to 8 carbon atoms) (for example, an alkenyl group (for example, an allyl group), a carboxyalkyl group (for example, a carboxymethyl group or a carboxyethyl group, etc.), a hydroxyalkyl group (for example a β-hydroxyethyl group, a γ-hydroxypropyl group or a β-hydroxypropyl group, etc.), an alkoxycarbonylalkyl group (for example, a methoxycarbonylmethyl group, a β-methoxycarbonylethyl group or an ω-ethoxycarbonylbutyl group, etc.), a sulfoalkyl group (for example, a β-sulfoethyl group or a γ-sulfopropyl group, etc.), an alkoxyalkyl group (for example, an unsubstituted alkoxyalkyl group (for example, a β-methoxyethyl group, a β-ethoxyethyl group or a γ-methoxypropyl group, etc.), or a substituted alkoxyalkyl group (for example, a hydroxyalkoxyalkyl group (for example, a hydroxymethoxymethyl group, a 2-hydroxyethoxymethyl group or a 2-(2-hydroxyethoxy)ethyl group, etc.) or an acetoxyalkoxyalkyl group (for example, a 2-(2-acetoxyethoxy)ethyl group or an acetoxymethoxymethyl group, etc.), etc.)), an acyloxyalkyl group (for example, an acetoxymethyl group, a β-acetoxyethyl group or a γ-acetoxypropyl group, etc.), a dialkylaminoalkyl group (wherein the alkyl moieties may combine to form a ring, for example, a 2-dimethylaminoethyl group, a 2-diethylaminoethyl group, a 3-dimethylaminopropyl group, a 2-piperidinoethyl group, a 2-alkyl (for example, methyl)-substituted piperidinoethyl group or a 2-morpholinoethyl group, etc.), an N-(N,N-dialkylaminoalkyl)carbamoylalkyl group (for example, a N-3-(N,N-dimethylamino)propyl carbamoylmethyl group, an N-[2-(N,N-diethylamino)ethyl]carbamoylmethyl group, an N-[3-(morpholino)propyl]carbamoylmethyl group or an N-[3-(piperidino)propyl]-carbamoylmethyl group, etc.), an N-(N,N,N-trialkylammonia alkyl)-carbamoylalkyl group (for example, an N-[3-(N,N,N-trimethylammonia)propyl]carbamoylmethyl group, an N-[3-(N,N,N-triethylammonia)propyl]carbamoylmethyl group, an N-[3-(N-methylmorpholinio)propyl]carbamoylmethyl group or an N-[3-(N-methylpiperidinio)propyl]carbamoylmethyl group, etc.), an N,N,N-trialkylammonium alkyl group (for example, an N,N-diethyl-N-methylammonioethyl group or an N,N,N-triethylammonioethyl group, etc.), a cyanoalkyl group (for example, a 2-cyanoethyl group or a 3-cyanopropyl group, etc.), a carbamoylalkyl group (for example, a 2-carbamoylethyl group or a 3-carbamoylpropyl group, etc.) or a heterocyclic substituted alkyl group (for example, a tetrahydrofurfurylmethyl group or a furfurylmethyl group, etc.) or an aryl group (including substituted aryl groups, for example, a phenyl group or a phenyl group substituted with one or more of a halogen atom, an alkyl group, an alkoxy group, a carboxy group or an alkoxycarbonyl group, etc. (for example, a p-chlorophenyl group, a p-tolyl group, a p-methoxyphenyl group, a p-carboxyphenyl group or a p-methoxycarbonylphenyl group, etc.), etc.).

$R_3$ represents an aryl group (an unsubstituted aryl group (for example, a phenyl group), a substituted aryl group (an aryl group substituted with, for example, one or more of an alkyl group, an alkoxy group, an alkoxycarbonyl group, a carboxy group, a halogen atom and a sulfo group, etc.(for example, a m-tolyl group, a p-tolyl group, a p-methoxyphenyl group, a p-carboxyphenyl group, a p-ethoxycarbonylphenyl group, a p-chlorophenyl group or a p-sulfophenyl group, etc.); wherein the preferred alkyl moiety has 1 to 4 carbon atoms), or an alkenyl group (for example, an allyl group, etc.).

More preferred merocyanine dyes of the present invention are represented by the formula (Ia)

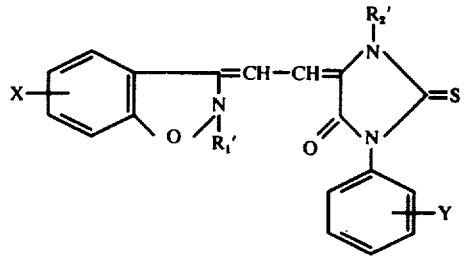

(Ia)

wherein $R'_1$ represents an aliphatic group (an unsubstituted alkyl group (having 1 to 3 carbon atoms) or a substituted alkyl group (having 1 to 4 carbon atoms in the alkyl moiety thereof), for example, a sulfo substituted alkyl group (for example, a β-sulfoethyl group, a γ-sulfopropyl group, a γ-sulfobutyl group, a δ-sulfobutyl group, a sulfoalkoxyalkyl group or a hydroxysulfoalkyl group, etc.) or a carboxyalkyl group (for example, a β-carboxyethyl group, an ω-carboxybutyl group or a carboxymethyl group, etc.), etc.). $R'_2$ represents an aliphatic group (an unsubstituted alkyl group (having 1 to 3 carbon atoms), or a substituted alkyl group (having 1 to 4 carbon atoms in the alkyl moiety thereof), for example, a carboxyalkyl group (for example, a carboxymethyl group or a carboxyethyl group, etc.), a hydroxyalkyl group (for example, a β-hydroxyethyl group, a γ-hydroxypropyl group or a β-hydroxypropyl group, etc.), an alkoxycarbonylalkyl group (for example, a methoxycarbonylmethyl group or a β-methoxycarbonylethyl group, etc.), a substituted alkoxyalkyl group (for example, substituted with a hydroxyl group or an acetoxy group, such as a 2-(2-hydroxyethoxy)ethyl group or a 2-(2-acetoxyethoxy)ethyl group, etc.), a dialkylaminoalkyl group (for example, a 2-dimethylaminoethyl group or a 3-diethylaminopropyl group, etc.), an N-(N,N-dialkylaminoalkyl)carbamoylalkyl group, an N-(N,N,N-trialkylammonia alkyl)carbamoylalkyl group, an N,N,N-trialkylammonia alkyl group, or a carbamoylalkyl group. X represents a hydrogen atom, a lower alkyl group (having 1 to 4 carbon atoms), an alkoxy group (having 1 to 4 carbon atoms), a halogen atom or an aryl group (for example, a phenyl group). Y represents a hydrogen atom, a lower alkyl group (having 1 to 4 carbon atoms), an alkoxy group (having 1 to 4 carbon atoms), a halogen atom, a carboxyl group or an alkoxycarbonyl group (having 2 to 5 carbon atoms.

Typical examples of the merocyanine dyes of the present invention are described in the following. However, the present invention is not to be construed as being limited to these dyes.
(1)
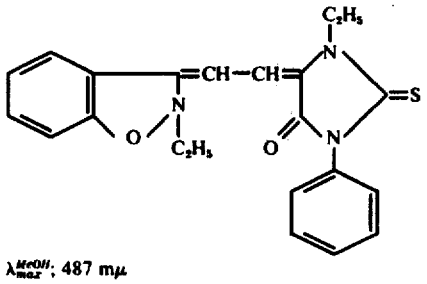
$\lambda_{max}^{MeOH}$: 487 mμ
(2)
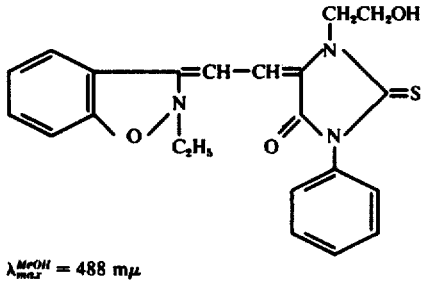
$\lambda_{max}^{MeOH}$ = 488 mμ
(3)
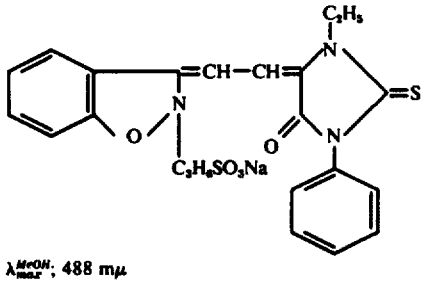
$\lambda_{max}^{MeOH}$: 488 mμ
(4)
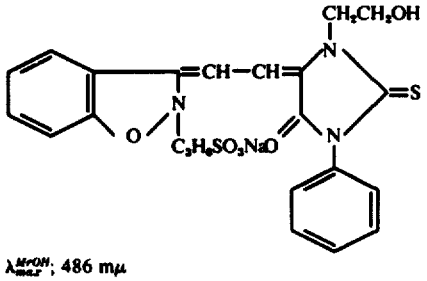
$\lambda_{max}^{MeOH}$: 486 mμ
(5)
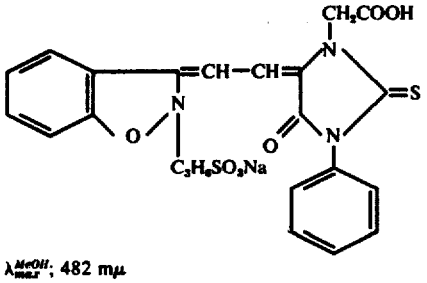
$\lambda_{max}^{MeOH}$: 482 mμ
(6)
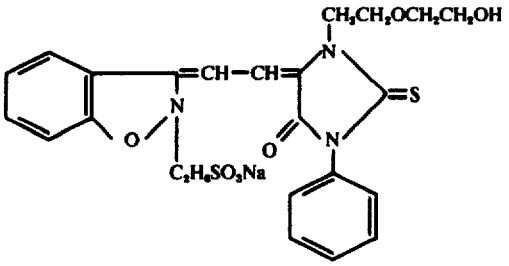

-continued
$\lambda_{max}^{MeOH}$: 488 mμ
(7)
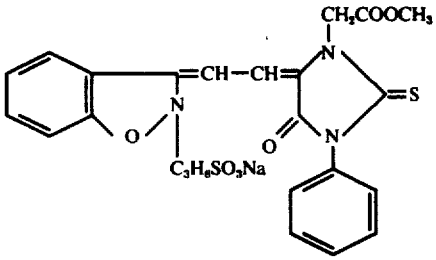
$\lambda_{max}^{MeOH}$: 485 mμ
(8)
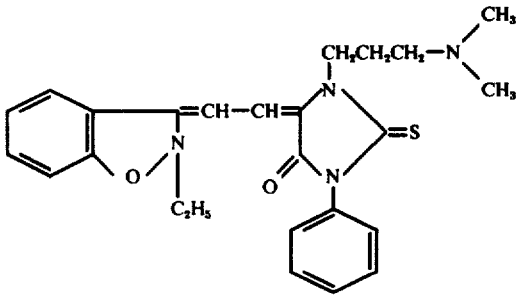
$\lambda_{max}^{MeOH}$: 487 mμ
(9)
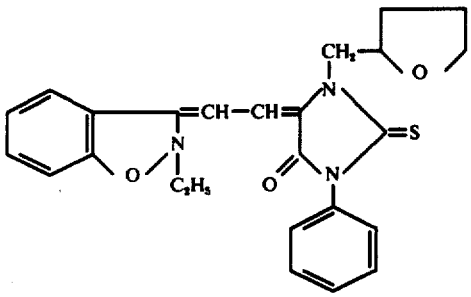
$\lambda_{max}^{MeOH}$: 487 mμ
(10)
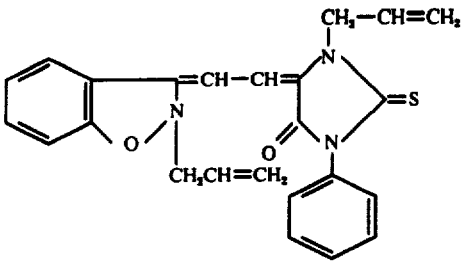
$\lambda_{max}^{MeOH}$: 487 mμ
(11)
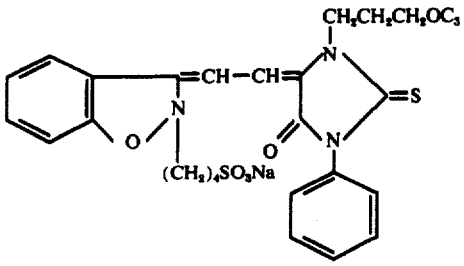
$\lambda_{max}^{MeOH}$: 488 mμ

-continued (12)

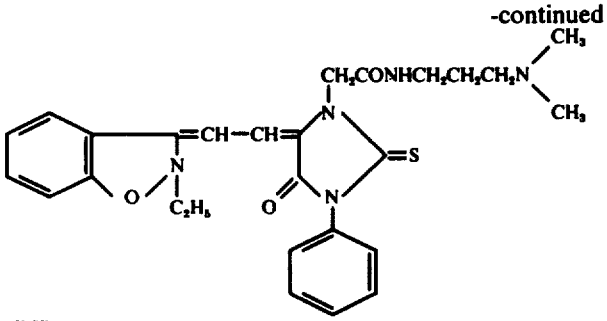

$\lambda_{max}^{MeOH}$; 488 mμ

(13)

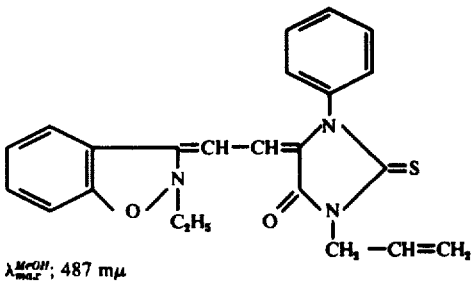

$\lambda_{max}^{MeOH}$; 487 mμ

(14)

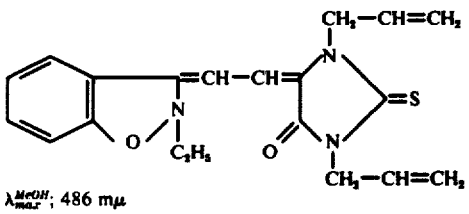

$\lambda_{max}^{MeOH}$; 486 mμ

(15)

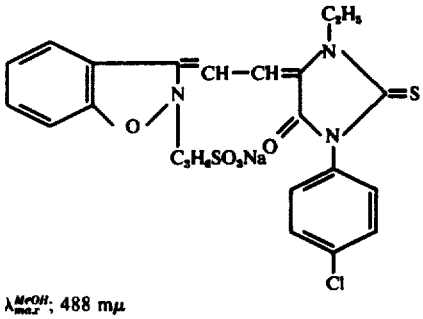

$\lambda_{max}^{MeOH}$; 488 mμ

(16)

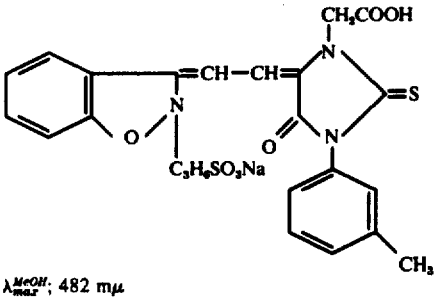

$\lambda_{max}^{MeOH}$; 482 mμ

The merocyanine dyes used in the present invention can be easily synthesized by reference to the disclosures in U.S. Pat. Nos. 2,493,748, 2,497,876, 2,519,001, 3,625,698, 3,384,486, 2,497,878, 3,567,458 and 3,625,698, Japanese Patent Publication No. 18108/1971, Japanese Patent Application (OPI) No. 1235/1971, and British Pat. No. 1,112,036.

Figure 2:
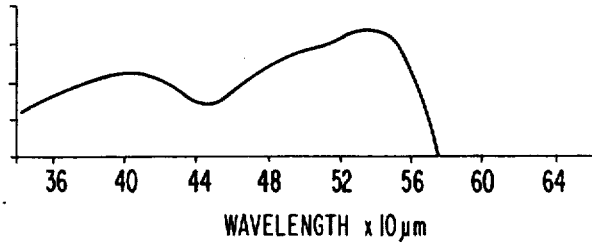
FIG. 2 shows the spectral sensitization curve of a photographic emulsion (immediately after preparation) produced using Sensitizing Dye (6) of the present invention in an amount of $32 \times 10^{-5}$ mols per Kg of the emulsion.
Figure 3:
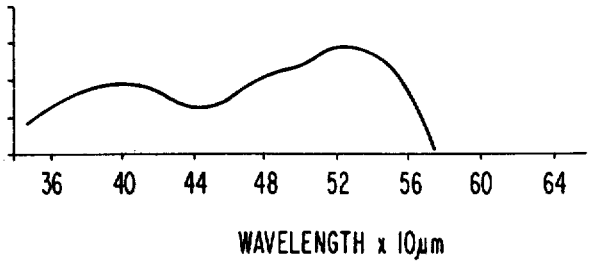
FIG. 3 shows the spectral sensitization curve of a photographic emulsion (immediately after preparation) produced using a dye for comparison in an amount of $16 \times 10^{-5}$ mols per Kg of the emulsion.
Figure 4:
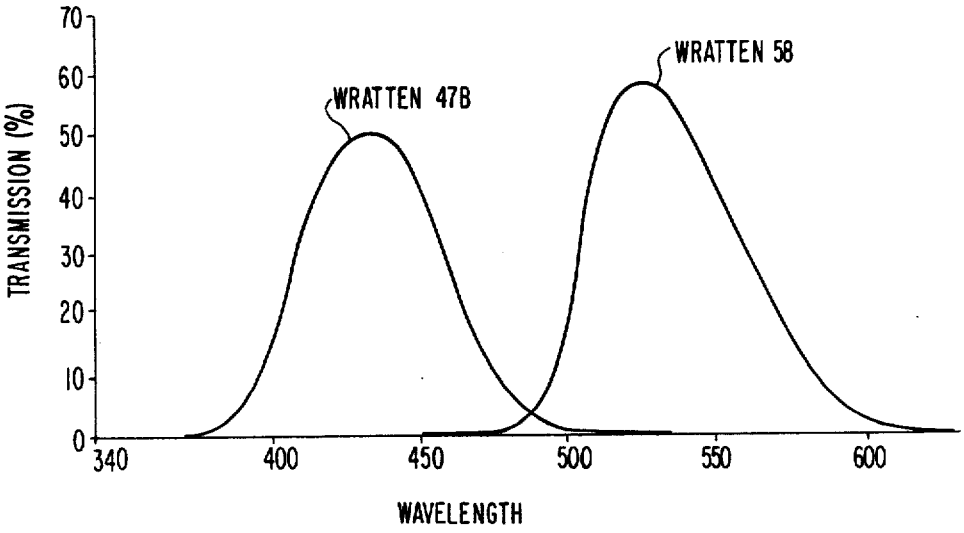
FIG. 4 shows the spectral transmission curves of Wratten filter 47B and Wratten filter 58 used for calculation of the relative speed.

The merocyanine dyes used in the present invention have as a chemical structural characteristic that they are dimethine merocyanine dyes comprising a benzisoxazole nucleus and a 2-thiohydantoin nucleus and particularly the 2-thiohydantoin nucleus has an aryl group (including a substituted aryl group) or an alkenyl group in the 3-position thereof. Namely, the merocyanine type sensitizing dyes of the present invention wherein $R_3$ in the formula (I) represents an aryl group or an alkenyl group have a higher spectral sensitization effect than merocyanine type sensitizing dyes wherein $R_3$ is an alkyl group or a substituted alkyl group, which is clear from the results shown in FIGS. 1, 2 and 3. Namely, in these dyes, the spectral sensitization maximum appears in a longer wavelength range, for example, in a range of about 530 to 550 nm, and spectrally sensitized silver halide photographic emulsions do not undergo desensitization with the lapse of time. Further, residual color after development is slight.

This is because the merocyanine dye easily forms an aggregate on the surface of silver halide particles in a highly absorbed state, if the 3-position of the 2-thiohydantoin nucleus of the merocyanine dye is substituted with an aryl group or an alkenyl group.

Silver halide photographic emulsions containing the novel merocyanine dyes of the present invention can be, of course, used for various black and white photographic sensitive materials. For example, they can be used for not only conventional photosensitive materials for photography but also photosensitive materials for X-rays, photosensitive materials for radiography, photosensitive materials for holography, photosensitive materials for microfilms, photosensitive materials for the black and white diffusion transfer process, direct positive photosensitive materials and lithographic photosensitive materials, etc. On the other hand, they can be used for multi-layer color photographic materials containing color couplers (for example, those described in U.S. Pat. Nos. 3,152,896 and 3,615,502 and Japanese Patent Publication 13111/1969), mixed grain type color photosensitive materials using a packet emulsion, color photosensitive materials for X-rays and photosensitive materials for the color diffusion transfer process.

The merocyanine dyes of the present invention have a spectral sensitization which hardly decreases even though color couplers are present in the material. Further, the merocyanine dyes of the present invention do not sensitize adjacent emulsion layers by diffusion therein.

The merocyanine dyes of the present invention are particularly excellent for increasing the blue-sensitivity and the green-sensitivity of lithographic emulsions and for improving lithographic development (for example, they prevent delay of development or increase the edge gradient). Further, they are suitable for spectral sensitization of emulsions for microfilms.

The silver halide photographic emulsions used in the present invention can be produced according to known conventional processes. For example, they can be produced by a single jet process, a double jet process or a combination of these processes according to various methods such as an ammonia method, a neutral method or an acid method, etc., by which the emulsions contain ripened particles of silver chloride, silver bromide, silver iodide or mixed silver halides (for example AgClBr, AgClI, AgClBrI or AgBrI), etc.). A preferred silver halide is silver bromochloride or silver iodobromochloride (where the mole percent of silver iodide is about 0.1 to 8% and preferably 0.1 to 5%). Although the crystal habit of the silver halide of the silver halide emulsion used in the present invention is not limited, particles having a (111) face, which is well known, are of course useful and, particularly, particles having a (100) face are preferred.

A preferred average particle size of silver halide particles (for example, that determined as a number average using the projected area method) ranges from about 0.02 $\mu$ to about 2 $\mu$. The processes for producing these emulsions have been described in, for example, C. E. K. Mees and T. H. James, *The Theory of the Photographic Process*, MacMillian Co., New York (1966) and P. Grafikides, *Photographic Chemistry*, Fountain Press Co.

The silver halide photographic emulsions used in the present invention can be sensitized using conventionally used chemical sensitization methods, for example, gold sensitization as described in U.S. Pat. Nos. 2,540,085, 2,597,856, 2,597,915 and 2,399,083, sensitization by Group VIII metal ions as described in U.S. Pat. Nos. 2,448,060, 2,540,086, 2,566,245, 2,566,263 and 2,598,079, sulfur sensitization as described in U.S. Pat. Nos. 1,574,944, 2,448,060, 2,399,083, 2,540,085, 2,540,086, 2,597,856, 2,278,947, 2,440,206, 2,410,689, 2,642,361, 3,189,458 and 3,415,659, reduction sensitization as described in U.S. Pat. Nos. 3,518,698, 2,419,974 and 2,983,610, and a combination of these sensitization methods. Examples of chemical sensitizers include sulfur sensitizers such as allylthiocarbamide, thiourea, sodium thiosulfate, cystine and sodium thiocyanate, etc., gold or Group VIII metal sensitizers such as iridium (III) chloride, iridium (IV) chloride, iridium (III) bromide, potassium hexachloroiridate (III), potassium hexachloroiridate (IV), ammonium hexachloroplatinate (IV), potassium hexachloroplatinate (IV), potassium chloroaurate, aurous thiosulfate and potassium chloropalladate, etc., and reduction sensitizers such as stannous chloride, phenylhydrazine, reductone or derivatives thereof.

Furthermore, polyoxyethylene derivatives, polyoxypropylene derivatives or derivatives having a quaternary ammonium group can be used as a sensitizer.

The silver halide photographic emulsions of the present invention can contain an antifogging agent such as azaindenes, mercaptotetrazoles, salts of noble metals such as palladium or platinum, oximes, imidazoles or the salts thereof, or tetrazolium salts, for example, nitrobenzimidazole or ammonium chloro platinate, as described in U.S. Pat. Nos. 2,444,605, 2,886,437, 2,403,927, 3,266,897, 3,399,987, 2,597,915, 3,566,263, 2,694,716, 2,131,038, 2,518,698, 3,369,904, 2,419,974 and 2,419,975; and a stabilizing agent such as 4-hydroxy-6-methyl-1,3,3a,7-tetrazaindene. Further, they can contain a hardening agent such as formaldehyde, chrom alum, sodium 1-hydroxy-3,5-dichlorotriazine, glyoxal or dichloroacrolein and a coating assistant such as saponin, a sodium alkylbenzene sulfonate or taurine derivatives.

The silver halide photographic emulsions used in the present invention can contain a protective colloid such as gelatin, acylated gelatins such as phthalated gelatin, cellulose derivatives such as hydroxyethyl cellulose or carboxymethyl cellulose, soluble starches such as dextrin, or a hydrophilic colloid such as polyvinyl alcohol, polyvinylpyrrolidone, polyacrylamide or polystyrene sulfonic acid, and a plasticizer for providing dimensional stability, latex polymers and a matting agent, etc., which are usually used for photographic sensitive materials.

Finished emulsions can be coated on suitable supports which do not adversely influence the photographic properties such as baryta paper, resin coated paper, cellulose triacetate films, polyethylene terephthalate films, glass plates and other synthetic resin films, etc. A suitable coating amount of the silver halide in each layer generally ranges from about 1 to 500 mg (as silver)/100 $cm^2$ of the support.

The sensitizing dyes used in the present invention can be added as an aqueous solution or as a solution in a watermiscible organic solvent such as methanol, ethanol, methyl cellosolve or pyridine, etc. (for example, as described in U.S. Patent Application Ser. No. 206,878, filed Dec. 10, 1971).

A method of adding the sensitizing dyes as a dispersion has been described in U.S. Pat. Nos. 3,482,981, 3,469,987, 3,658,546, and 3,660,101, British Pat. Nos. 1,271,329 and 1,038,029, and German Patent Application (OLS) 2,107,283. A method of adding the sensitizing dyes by adsorption on silica has been described in German Patent Application (OLS) 1,947,935. On the other hand, ultrasonic dissolution of the sensitizing dyes which is a special example of addition has been described in U.S. Pat. No. 3,485,634. In addition, it is possible to spectrally sensitize the emulsion using the method described in Japanese Pat. Application Nos. 128754/1973 or 128755/1973. The amount of the sensitizing dyes used is that amount sufficient to spectrally sensitize, for example, about $1 \times 10^{-6}$ to $5 \times 10^{-3}$ mols per mol of silver and preferably $1 \times 10^{-5}$ to $2.5 \times 10^{-3}$ mols per mol of silver. Particularly, a range of $8 \times 10^{-5}$ to $1 \times 10^{-3}$ mols is preferred. The addition of the sensitizing dyes can be carried out during, just before or after ripening of the second ripening step. But it is preferred to add the sensitizing dye just before conclusion of the second ripening.

Some of the effects and advantages of the present invention are as follows:

(1) It is possible to obtain silver halide photographic emulsions wherein the spectral sensitivity is remarkably improved (particularly, the green-sensitivity is high) and the generation of fog is reduced.

(2) It is possible to obtain spectrally sensitized silver halide photographic emulsions wherein the decrease of sensitivity with the lapse of time after preparation is reduced.

(3) After development, silver halide photographic emulsions which do not have residual color can be obtained.

(4) The sensitizing dyes employed can be conveniently added to the emulsions, because they have excellent solubility.

(5) The sensitizing dyes of the present invention can be easily synthesized in a high yield.

The following examples are given to illustrate the present invention in greater detail. Unless otherwise indicated, all parts, percents, ratios and the like are by weight.

EXAMPLE

A silver iodobromochloride (iodide content: 0.25 mol% and bromide content: 16.5 mol%) emulsion was produced by a process comprising precipitating silver halide particles by a double jet method, carrying out physical ripening in a conventional manner, de-salting and then carrying out chemical ripening. The average diameter of the silver halide particles present in this emulsion was 0.4 $\mu$. 1.18 mols of silver halide was included in 1 Kg of this emulsion. 1 Kg of this emulsion was weighed and dissolved using a constant temperature bath at 50° C.

A methanol solution of a sensitizing dye of the present invention and a methanol solution of a sensitizing dye for comparison were added respectively in a specific amount and the mixture was stirred at 40° C.

20 cc of a 1 wt% aqueous solution of 4-hydroxy-6-methyl-1,3,3a,7-tetrazaindene and 10 cc of a 1 wt% aqueous solution of sodium 1-hydroxy-3,5-dichlorotriazine were added thereto, and then 10 cc of a 1 wt% aqueous solution of sodium dodecylbenzene sulfonate was added and the mixture was stirred. The finished emulsions were applied to cellulose triacetate film supports in a dry film thickness of 5 $\mu$ to produce samples of photosensitive materials. These samples were cut into strips. A part of these strips was allowed to stand for 2 days in a room conditioned at 50° C and a relative humidity of 80%. Thus, fresh samples and samples which were stored under severe conditions for sensitive materials were obtained. One of the samples was exposed to a light wedge through a blue filter (Wratten 47B) or a green filter (Wratten 58) using a sensitometer which had a light source having a color temperature of 5400° K. Additionally a sample was exposed to light using a grating spectrographic camera having a tungsten light source of a color temperature of 2666° K in order to obtain a spectrogram.

Then, the samples were developed at 20° C for 2 minutes using a developer having the following composition, stopped, fixed and washed with water to produce strips having black and white images. These were evaluated using a S-type densitometer produced by the Fuji Film Co., Ltd. to obtain the blue-filter sensitivity (SB), the green-filter sensitivity (SG) and fog. The standard point of optical density for determination of the sensitivity was (fog + 0.20).

| Composition of the Developer | |
|---|---|
| Water | 500 ml |
| Metol | 2 g |
| Sodium Sulfite (anhydrous) | 40 g |
| Hydroquinone | 4 g |
| Sodium Carbonate (monohydrate) | 28 g |
| Potassium Bromide | 1 g |
| Water to make | 1 liter |

At use, an equivalent volume of water was added. The results obtained are shown in Table 1 as relative values. Namely, the results of the determinations of the relative blue-sensitivity and green-sensitivity, fog and residual color in the case of using the merocyanine dye of the present invention and in the case of using the dye for comparison and the results of determinations of sensitivity and fog after the lapse of time of the silver halide photographic emulsion of the present invention are shown in Table 1.

Table 1

| Run No. | Sensitizing Dye and Amount Thereof ($\times 10^{-5}$ mols/kg of emulsion) | | Fresh Sample SG (relative value) | Fresh Sample SB (relative value) | Fresh Sample Fog | Fresh Sample Residual Color* | Sample after Standing for 2 days at 50° C and 80% Relative Humidity SG (relative value) | Sample after Standing for 2 days at 50° C and 80% Relative Humidity SB (relative value) | Sample after Standing for 2 days at 50° C and 80% Relative Humidity Fog |
|---|---|---|---|---|---|---|---|---|---|
| 1 | (1) | 0 | — | 100 (control) | 0.05 | None | — | 96 | 0.05 |
| | | 8 | 125 | 135 | 0.05 | None | 120 | 132 | 0.05 |

Table 1-continued

| Run No. | Sensitizing Dye and Amount Thereof ($\times 10^{-5}$ mols/kg of emulsion) | | Fresh Sample SG (relative value) | Fresh Sample SB (relative value) | Fresh Sample Fog | Fresh Sample Residual Color* | Sample after Standing for 2 days at 50° C and 80% Relative Humidity SG (relative value) | Sample after Standing for 2 days at 50° C and 80% Relative Humidity SB (relative value) | Sample after Standing for 2 days at 50° C and 80% Relative Humidity Fog |
|---|---|---|---|---|---|---|---|---|---|
| | | 16 | 168 | 145 | 0.06 | Slight | 168 | 145 | 0.06 |
| | | 32 | 226 | 166 | 0.07 | Slight | 220 | 160 | 0.07 |
| 2 | (2) | 8 | 136 | 135 | 0.05 | None | 136 | 135 | 0.05 |
| | | 16 | 192 | 135 | 0.05 | None | 180 | 135 | 0.06 |
| | | 32 | 200 | 145 | 0.06 | Slight | 190 | 142 | 0.06 |
| 3 | (4) | 8 | 136 | 126 | 0.05 | None | 132 | 126 | 0.05 |
| | | 16 | 175 | 135 | 0.05 | None | 175 | 135 | 0.05 |
| | | 32 | 175 | 135 | 0.05 | None | 180 | 135 | 0.05 |
| 4 | (6) | 8 | 117 | 122 | 0.05 | None | 112 | 117 | 0.05 |
| | | 16 | 147 | 122 | 0.05 | None | 142 | 117 | 0.05 |
| | | 32 | 168 | 122 | 0.05 | None | 174 | 122 | 0.05 |
| 5 | (7) | 8 | 100 | 122 | 0.05 | None | 105 | 122 | 0.05 |
| | | 16 | 142 | 135 | 0.05 | None | 147 | 135 | 0.05 |
| | | 32 | 164 | 135 | 0.05 | None | 164 | 135 | 0.05 |
| 6 | (10) | 8 | 120 | 130 | 0.05 | None | 115 | 130 | 0.05 |
| | | 16 | 158 | 135 | 0.06 | None | 154 | 135 | 0.06 |
| | | 32 | 210 | 138 | 0.06 | Slight | 200 | 135 | 0.06 |
| 7 | (11) | 8 | 128 | 120 | 0.05 | None | 122 | 120 | 0.05 |
| | | 16 | 160 | 135 | 0.05 | None | 160 | 135 | 0.05 |
| | | 32 | 195 | 145 | 0.05 | None | 195 | 145 | 0.05 |
| 8 | (14) | 8 | 122 | 130 | 0.05 | None | 110 | 117 | 0.05 |
| | | 16 | 155 | 148 | 0.06 | Slight | 142 | 135 | 0.06 |
| | | 32 | 195 | 154 | 0.07 | Slight | 175 | 140 | 0.07 |
| 9 | Dye for Comparison** | 8 | 35 | 72 | 0.06 | Slight | 24 | 61 | 0.08 |
| | | 16 | 40 | 67 | 0.07 | Slight | 29 | 57 | 0.08 |
| | | 32 | 35 | 63 | 0.07 | Some | 27 | 57 | 0.10 |

*Evaluation of residual color:
Some>slight>none

**Comparison Dye:

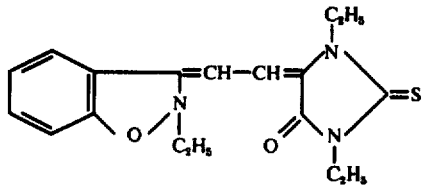

It is clear from the results of the evaluations shown in Table 1 that silver halide photographic emulsions containing a merocyanine dye of the present invention have remarkably high blue- and green-sensitivities as compared with merocyanine dyes wherein the nitrogen atom of the 3-position of the corresponding 2-thiohydantoin nucleus is substituted with an alkyl group (comparison dye), and they have less fog and residual color. Further it is clear that the decrease of the sensitivity with the lapse of time is small and that fog does not increase.

While the invention has been described in detail and with reference to specific embodiments thereof, it will be apparent to one skilled in the art that various changes and modifications can be made therein without departing from the spirit and scope thereof.

What is claimed is:

1. A silver halide photographic emulsion which contains at least one sensitizing dye represented by the formula (I)

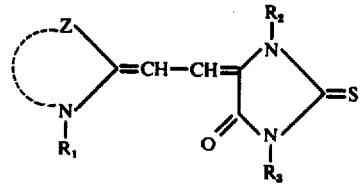

(I)

wherein Z represents a group of atoms necessary to form a benzisoxazole nucleus; $R_1$ represents an aliphatic group; $R_2$ represents an aliphatic group or an aryl group; and $R_3$ represents an unsubstituted phenyl group or an alkenyl group.

2. The silver halide photographic emulsion of claim 1, wherein said sensitizing dye represented by the formula (I) is represented by the formula (Ia)

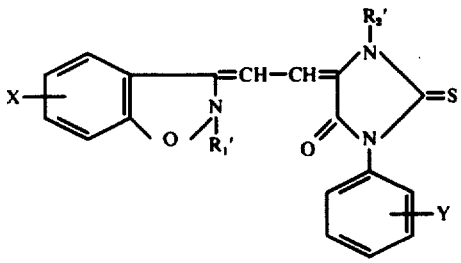

(Ia)

wherein $R'_1$ and $R'_2$ each represents an aliphatic group, X represents a hydrogen atom, a lower alkyl group, an alkoxy group, a halogen atom or an aryl group, and Y represents a hydrogen atom.

3. The silver halide photographic emulsion of claim 2, wherein X and Y each represents a hydrogen atom.

4. The silver halide photographic emulsion of claim 2, wherein $R'_1$ is an alkyl group, a sulfoalkyl group or a carboxyalkyl group and $R'_2$ represents an alkyl group, a carboxyalkyl group, a hydroxyalkyl group, an alkoxycarbonylalkyl group, a substituted alkoxyalkyl group, a dialkylaminoalkyl group, an N-(N,N-dialkylaminoalkyl)carbamoylalkyl group, an N-(N,N,N- trialkylammoniaalkyl)carbamoylalkyl group, an N,N,N-trialkylammoniaalkyl group or a carbamoylalkyl group.

5. The silver halide photographic emulsion of claim 1, wherein said emulsion contains silver bromochloride or silver iodobromochloride.

6. The silver halide photographic emulsion of claim 1, wherein said emulsion contains predominantly silver halide particles having a (100) face.

7. The silver halide photographic emulsion of claim 2, wherein $R'_2$ represents an alkyl group, a hydroxyalkyl group, a carboxyalkyl group or an alkoxycarbonylalkyl group.

8. The silver halide photographic emulsion of claim 2, wherein $R'_1$ is an unsubstituted alkyl group or a sulfoalkyl group.

9. The silver halide photographic emulsion of claim 2, wherein said sensitizing dye represented by the formula (I) is 1-ethyl-3-phenyl-5-[(3-sulfopropyl-3(2)-benzisoxazolylidene)-ethylidene]-2-thiohydantoin sodium salt, 1-hydroxyethyl-3-phenyl-5-[(3-sulfopropyl-3(2)-benzisoxazolylidene)ethylidene]-2-thiohydantoin sodium salt or 1-carboxymethyl-3-pheyl-5-[(3-sulfopropyl-3(2)-benzisoxazolylidene)ethylidene]-2-thiohydantoin sodium salt.

10. The silver halide photographic emulsion of claim 1, wherein said photographic emulsion is a lithiographic silver halide emulsion.

11. A silver halide photographic material comprising a support having thereon a layer of the silver halide photographic emulsion of claim 1.

12. The silver halide photographic emulsion of claim 1, wherein $R_3$ represents an allyl group.

13. The silver halide photographic emulsion of claim 1, wherein said sensitizing dye represented by the formula (I) is represented by the formula (Ib)

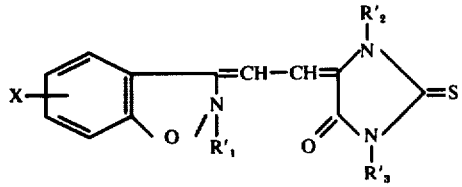

(Ib)

wherein $R'_1$ and $R'_2$ each represents an aliphatic group, X represents a hydrogen atom, a silver alkyl group, an alkoxy group, a halogen atom or an aryl group, and $R'_3$ represents an alkenyl group.

14. The silver halide photographic emulsion of claim 13, wherein $R'_3$ represents an allyl group.

15. The silver halide photographic emulsion of claim 14, wherein X represents a hydrogen atom.

16. The silver halide photographic emulsion of claim 13, wherein $R'_1$ is an alkyl group, a sulfoalkyl group or a carboxyalkyl group and $R'_2$ represents an alkyl group, a carboxyalkyl group, a hydroxyalkyl group, an alkoxycarbonylalkyl group, a substituted alkoxyalkyl group, a dialkylaminoalkyl group, an N-(N,N-dialkylaminoalkyl) carbamoylalkyl group, an N-(N,N,N-trialkylammonialkyl) carbamoylalkyl group, an N,N,N-trialkylammonioalkyl group or a carbamoylalkyl group.

17. The silver halide photographic emulsion of claim 12, wherein said emulsion contains silver bromochloride or silver iodobromochloride.

18. The silver halide photographic emulsion of claim 12 wherein said emulsion contains predominantly silver halide particles having a (100) face.

19. The silver halide photographic emulsion of claim 13, wherein $R'_2$ represents an alkyl group, a hydroxyalkyl group, a carboxyalkyl group or an alkoxycarbonylalkyl group.

20. The silver halide photographic emulsion of claim 13, wherein $R'_1$ is an unsubstituted alkyl group or a sulfoalkyl group.

21. The silver halide photographic emulsion of claim 13, wherein said photographic emulsion is a lithiographic silver halide emulsion.

22. A silver halide photographic material comprising a support having thereon a layer of the silver halide photographic emulsion of claim 13.

* * * * *